United States Patent [19]

Rebeyrolle et al.

[11] Patent Number: 5,031,384

[45] Date of Patent: Jul. 16, 1991

[54] PROCESS FOR THE PRODUCTION AND PACKAGING OF A BAG-TYPE DISPENSER, SUB-ASSEMBLIES AND CORRESPONDING DISPENSERS

[75] Inventors: Michel Rebeyrolle; Bernard Schneider, Sainte-Ménéhould, France

[73] Assignee: Cebal, Clichy, France

[21] Appl. No.: 384,430

[22] Filed: Jul. 25, 1989

[30] Foreign Application Priority Data

Jul. 25, 1988 [FR] France ..... 88 10228
Dec. 23, 1988 [FR] France ..... 88 17625

[51] Int. Cl.[5] ..... B65B 31/00; B65B 43/00

[52] U.S. Cl. ..... 53/452; 53/470; 141/3; 141/20; 222/95; 222/389

[58] Field of Search ..... 53/242, 452, 449, 456, 53/470, 469, 471; 141/3, 20; 222/95, 105, 386.5, 389; 264/267, 275, DIG. 41; 156/69, 272.6

[56] References Cited

U.S. PATENT DOCUMENTS 2,415,906 2/1947 Paige ..... 156/69 X
3,020,594 2/1962 Makowski ..... 264/DIG. 41 X
3,020,688 2/1962 Modderno .
3,169,670 2/1965 Hrebenak et al. .
3,317,090 5/1967 Meshberg .
3,662,926 5/1972 Umstead ..... 222/95
3,791,098 2/1974 Webster ..... 53/452
3,988,413 10/1976 Gaudet et al. ..... 264/DIG. 41 X
4,008,830 2/1977 Meshberg .
4,147,278 4/1979 Uhlig ..... 222/94
4,189,069 2/1980 Stoody ..... 222/105 X
4,211,344 7/1980 Stoody ..... 141/20 X
4,365,716 12/1982 Watt ..... 156/272.6 X
4,375,743 3/1983 Sullivan ..... 53/470 X
4,457,455 7/1984 Meshberg .
4,671,428 6/1987 Spatz ..... 222/105

*Primary Examiner*—Robert L. Spruill
*Assistant Examiner*—Linda B. Johnson
*Attorney, Agent, or Firm*—Dennison, Meserole, Pollack & Scheiner

[57] ABSTRACT

The invention concerns a process for the production and packaging of a bag-type dispenser comprising a casing surmounted by a dome, a sealed flexible bag fixed in said casing and dispensing means sealingly connected to said dome and to said bag characterized in that, prior to any other assembly and packaging operation, a dome of plastics material is produced by moulding, the dome comprising an internal tubular portion permitting sealing fixing thereon on to the upper end of a skirt forming the blank for the bag, and then said fixing is produced, thus providing a preassembled component, dome+-skirt, the dome further comprising portions for fixing thereof respectively on to the upper end of the casing and to the dispensing means. The invention also concerns the resulting sub-assemblies and bag-type dispensers. The invention is used in the pharmaceutical, cosmetological, hygiene and foodstuff fields.

26 Claims, 7 Drawing Sheets

PROCESS FOR THE PRODUCTION AND PACKAGING OF A BAG-TYPE DISPENSER, SUB-ASSEMBLIES AND CORRESPONDING DISPENSERS

The invention concerns a bag-type dispenser and a process for the production and packaging thereof. A bag-type dispenser of that kind is used for cosmetic, pharmaceutical, hygiene or foodstuff products.

FR-A-2 310 827 corresponding to U.S. Pat. No. 4,045,860 describes a container of aerosol type with two chambers or of "bag type" wherein, in order to produce a perfect seal at the location at which the bag is fixed to the external container or casing, an annular seal is set in position between the rolled edge of the dome of the casing and the collar portion of the bag, the collar portion being disengaged from the casing by an extractor and then the extractor itself being disengaged from the bag. The fixing cap of the dispensing valve is then set in position on the upper rim of the casing and the peripheral collar of the cap is crimped around the rolled edge, whereby the annular seal is gripped between the rolled edge and the collar portion of the bag on the one hand and the collar of the valve fixing cap on the other hand. The assembly operations which conclude with the crimping operation are thus delicate and relatively complex.

The applicants sought to develop a production process in which the assembly operations are simplified, in particular those which follow the production of the casing.

STATEMENT OF THE PROBLEM

The invention concerns a process for the production and packaging of a bag-type dispenser comprising a casing surmounted by a dome, a sealed flexible bag fixed to the interior of said casing and dispensing means sealingly connected to said dome and to said bag. According to the invention, before any other assembly and packaging operation, a dome of plastics material is produced by moulding, the dome comprising an internal tubular portion permitting sealing fixing thereof onto the upper end of a skirt forming the blank of the bag, and then said fixing is produced, thus providing a preassembled component (dome+skirt), the dome further comprising portions for fixing thereof respectively to the upper end of the casing and to the dispensing means. The bag-blank skirt is thus sealingly fixed to a dome which will connect the casing to the dispensing means, instead of being fixed to the casing as in the prior art.

In this description the vertical direction is by convention the direction of the longitudinal axis of the casing and the skirt or bag and the top of the dispenser or the component parts thereof corresponds to the end of the dispenser which carries the dispensing means.

The preassembled component (dome+skirt) has important advantages:

the shaping and assembly operations are facilitated;

the problem of making a seal between the bag and the upper edge of the casing is simplified;

the component (dome+skirt) can be sealingly fixed either firstly to the upper end of the casing or firstly to the dispensing means, which permits the bag to be filled by way of the top or by way of the bottom;

the axis of the upper opening of the dome and therefore the direction in which the product is dispensed can be oriented in various ways by simply changing the geometry of the dome;

the production process can be adapted to varying types of dispensers:

having a metal casing, with a dispensing valve and a propellent gas between the bag and the casing;

or having a metal casing or a casing of plastics or metalloplastic material, with a dispensing pump with low or zero intake of air, the bag then being subjected to atmospheric pressure; and as will be seen, the methods of fixing the component (dome+skirt) are varied and simple and reliable from the industrial point of view, and the choice thereof makes it possible to carry out the production process with various types of equipment.

The operation of sealingly fixing the internal tubular portion of the dome onto the upper end of the bag blank skirt is effected either by means of a clamping ring or an elastic band clamping the skirt around the tubular portion, possibly in an annular groove in the tubular portion, which construction can be used for short production runs, or preferably, for long production runs, by moulding in the operation of moulding the dome, or by glueing the end of the skirt around said tubular portion.

When the component (dome+skirt) is directly produced by moulding, a portion of the tubular skirt 4 is fitted around a punch 60 in such a way that its upper end 40 projects beyond the punch 60 by a selected length (FIG. 16). The skirt is then contained between the punch and the die tools 61, 62 which, with said projecting end 40, with a tool 63 which is internal to the punch 60 and with die bottom tools 64, define an annular space 65 which is fed with plastics material, typically by means of at least two lateral or inclined injection ducts 66.

The annular moulding space which is defined in that way is of a cross section corresponding to the profile of the dome portion to be produced, and makes it possible to remove from the mould the desired component (dome+skirt). The skirt is connected to the dome portion of that component by an internal tubular portion which is suitable for being mounted in the neck of the casing.

The upper end of the skirt which is fitted into the tubular portion by the moulding operation can thus be disposed: either flush with the internal surface of the tubular portion, or in the thickness of said tubular portion and preferably closer to the external surface of the internal tubular portion of the dome than its internal surface, or, even more advantageously in regard to the operation of moulding the dome onto the skirt, at the external surface of said tubular portion. Experience has also shown that the sleeve or sheath, which was usually very thin, being for example 0.2 to 0.3 mm in thickness, had a tendency, once used as a bag, to close up at the end of an emptying operation due to a twisting or kinking effect, that situation arising when the top end of the bag was welded to the tubular portion of the dome over only 3 to 4 mm. That disadvantage is avoided and more complete emptying of the bag when finishing dispensing of the product is attained by taking a higher internal tubular portion of the dome and carrying out the moulding operation in such a way that the end of the bag is contained in the thickness of the dome, that is to say typically its internal tubular portion, or connected to that tubular portion, over from 5 to 20 mm in height, with the optimum dimension being from 8 to 15 mm.

When the upper end of the sealing skirt is glued around the internal tubular portion of the dome, it is preferably for one of the two surfaces to be glued to be subjected to surface oxidation beforehand, typically by a flame process or a corona effect. When the internal surface of the skirt is of PE, it must thus be subjected to surface oxidation in order to achieve good adhesion for the glue. It is necessary to ensure that the glue which is then usually applied to the tubular portion is not completely scraped off by the operation of introducing the skirt. A first solution is to leave a slight clearance between the skirt and the tubular portion, with the internal diameter of the skirt being about 0.2 to 0.3 mm larger than the external diameter of the tubular portion so as to leave a film of glue.

A second and better solution is to have one or more annular recessed zones for retaining glue on the surface of the tubular portion of the dome which is to be stuck, the zones being of a depth of less than 0.15 mm in order to facilitate the operation of removing the moulded dome from the mould, that configuration preferably being used in conjunction with the skirt being lightly clamped around the tubular portion. When the arrangement has a plurality of annular zones, with the optimum dimensions involving a height or width of between 0.5 and 2.5 mm and a depth of between 0.04 and 0.1 mm, they are advantageously connected together by recessed passages or bridging portions of an equal or similar depth so as to improve the distribution of the glue at the time at which the skirt is fitted therearound. In order to permit more convenient and securer glueing, the annular zones may also be preceded by an end portion bearing an upwardly inclined flexible annular lip serving as a reserve of glue, the bottom of the reserve being connected to the most closely adjacent recessed annular zone, that is to say the first recessed annular zone starting from the end of the tube portion, by way of recessed bridging portions. The operation of fitting the skirt around the tubular portion then squeezes down the flexible lip, expelling glue towards the recessed annular zone or zones, that glue being propagated by way of the recessed bridging portions.

The glueing tests which were carried out showed that cyanoacrylate glues were particularly suitable for industrial protection, the annular dome preferably being made of polyamide, polyacetal or polycarbonate for rigidity thereof while the skirt being made at least at its internal surface of PE (polyethylene). Once the component (dome+skirt) has been produced, the production sequences may vary substantially, the operations then being distributed as between the package manufacturer and the packager, in the way that suits them best.

In accordance with a first production procedure, the other assembly and packaging operations are carried out in the following order:

(a) closing the lower end of the skirt of the component (dome+skirt), the skirt becoming a bag;
(b) introducing said bag of the previous component which became (dome+bag) into the casing;
(c) sealingly fixing said component by its dome portion to the upper end of the casing; and then, at the packagers:
(d) effecting filling of the product to be dispensed by way of the top of the bag;
(e) sealingly fixing to the top of the dome portion the dispensing means comprising either a valve or a pump with a low or zero intake of air; and
(f) when the dispensing means comprise a valve, introducing gas under pressure between the bag and the casing.

In accordance with a second production procedure in which packaging and assembly are integrated, the other assembly and packaging operations are carried out in the following order:

($a_1$) sealingly fixing to the dome of the component (dome+skirt) the dispensing means comprising either a valve or a pump with a low or zero intake of air;
($b_1$) turning the resulting assembly over and filling the skirt which is closed by the dome and by said dispensing means with the product to be dispensed, by way of the lower end of the skirt which is disposed in the upward position;
($c_1$) closing said end of the skirt which becomes a bag;
($d_1$) introducing the filled bag of the new assembly produced (dome+bag+dispensing means) into the casing;
($e_1$) sealingly fixing that new assembly by way of its dome portion to the upper end of the casing;
($f_1$) when the dispensing means comprise a valve, introducing a gas under pressure between the bag and the casing.

In the case where the dispensing means then comprise a pump 18 with a low or zero intake of air, provided with an annular fixing rim 180 at least externally of plastics material, it is advantageous in a mass production situation to carry out the operation of fixing the pump 18 to the dome 2—that is to say operation ($a_1$)—at the same time as the operation of fixing the skirt 4 or dome 2 by moulding. The direct moulding procedure already described above in regard to the component (dome+skirt) is modified in that the annular mould cavity 650 defining the dome 2 contains the periphery of the annular rim 180 of the pump 18. The tools containing the pump 18 and protecting it from the heating effect of the moulding operation are a lower tool 67 with a central cavity 68 which is surmounted by a rim 69 sealingly supporting said rim 180, and a die bottom tool 70 which caps the pump 18 and which bears against the rim 180, completing the sealing effect with respect to the molten plastics material. The connection produced between the dome and the rim of the pump is either a weld if the plastics materials in question are of the same nature, or a glueing effect with intimate adhesion, without refusion, which however provides a good sealing effect, as has been verified, when the plastics materials are dissimilar, for example polypropylene for the ring of the pump and HD-PE for the dome. In order to improve the strength of the fixing and the reliability of the corresponding sealing effect, it is then desirable to provide the annular rim in the part thereof which is involved in the moulding with at least one fine circular rib or groove. Once the assembly of the dome+skirt+pump has been produced in that way, the procedure them continues with operations ($b_1$) to ($e_1$).

In accordance with a third production procedure and when using a metal casing comprising a separate tubular body and bottom, when for example both are of tin plate or possibly aluminium, the other assembly and packaging operations are carried out in the following order:

($a_2$) sealingly fixing to the dome of the component (dome+skirt) the dispensing means comprising either a valve or a pump with a low or zero intake of air;

($b_2$) introducing the skirt of the resulting assembly (skirt+dome+dispensing means) into the body of the casing;

($c_2$) sealingly fixing said assembly by means of its dome portion to the upper end of said casing body; and then at the packagers:

($d_2$) turning over the resulting complex assembly and filling the skirt which is closed by way of the dome and the dispensing means with the product to be dispensed, by way of the lower end of the skirt which is disposed in the upward position;

($e_2$) closing said end of the skirt which becomes a bag and if necessary putting that end back into the casing body;

($f_2$) crimping the metal bottom which is pierced with a hole over the open lower end of the metal body; and ($g_2$) when the dispensing means comprise a valve, introducing a gas under pressure between the bag and the casing and closing the hole in the metal bottom.

As in the second production procedure, when the dispensing means comprise a pump with a low or zero intake of air bearing an annular fixing rim at least externally of plastics material, it is an attractive proposition firstly to produce a dome of plastics material which is moulded both onto the skirt forming the blank for the bag and around said fixing rim of the pump. After having produced an assembly (dome+skirt+pump) in that way, the procedure is continued with operations ($b_2$) and ($c_2$) and then usually at the packagers by the same operations ($d_2$) to ($g_2$).

It is possible to go further in the case of pre-assembly by moulding and directly to produce an assembly of (dome+skirt+pump +metal tubular body), which then replaces the elementary moulding (dome+skirt) and operations ($a_2$) to ($c_2$).

The moulding tools are then of the same type as those described in regard to the alternative form of the second production procedure, with the following modifications:

There is a double concentric punch for positioning of the skirt of the bag and the skirt of the tubular metal body and for removal of the moulded components from the mould, and the annular mould cavity surrounds a rolled edge prepared at the upper end of the metal tubular body, the connection of the dome being effected at that location by filling of the interior and the exterior of the rolled edge. The rolled or folded edge is not closed and can be tightened much less than a rolled edge for crimping, which is an advantage in terms of ease of production and flexibility.

The resulting complex assembly is then ready for packaging operations ($d_2$) to ($f_2$).

Besides the operations for moulding assemblies of components or "dispensing sub-assemblies" as already described above, different methods of fixing the component (dome+skirt) can be used and will be described in relation to the following examples and the drawings illustrating same. The mode of closure of the lower end to give a bag is important to facilitate the inward movement of the bag into the casing and will also be described.

The invention also concerns the preassembled component (dome+skirt) as well as the different assemblies or sub-assemblies produced.

EXAMPLE 1

Figure 1:
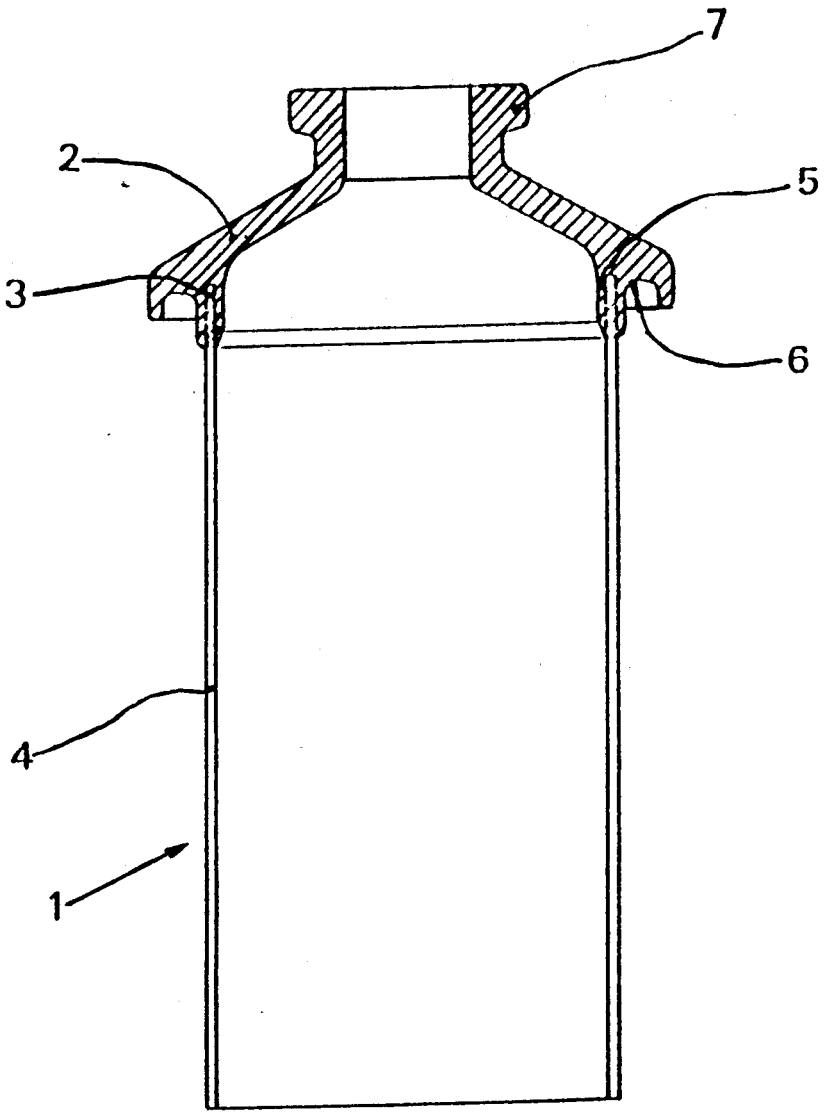
FIG. 1 is a view in axial section of a preassembled component (dome+skirt)

The component (dome+skirt) in FIG. 1 comprises a dome of high-density polyethylene (HD-PE) which is moulded onto the upper end portion 3 of a metalloplastic skirt 4 of an external diameter of 35 mm and of a thickness of 0.28 mm, comprising 5 layers, formed by the following, starting from the outside and moving inwardly:

1 layer of white LD-PE (with the addition of titanium oxide powder) of a thickness of 90 μm;

1 layer of copolymer adhesive based on EAA, of a dimension of 30 μm;

1 layer of aluminium of a thickness of 40 μm;

1 further layer of the same adhesive, of a dimension of 30 μm; and 1 internal layer of MD-PE of a thickness of 90 μm.

The upper end 3 of the skirt 4 was trapped by the moulding operation in an internal tubular portion 5 of the dome 2, of an external diameter of 36.3 mm, over a height of 13 mm, its internal and external layers accordingly being partially re-melted and welded and the covering of plastics material on the dome being 0.8 mm on the outward side and 1.5 mm on the inward side. That arrangement provides the top of the skirt which is closed in a bag configuration with a sufficient degree of rigidity for the opening of the bag to remain in the last phases of dispensing of product therefrom.

The dome portion 2 comprises on the outside of its internal tubular portion 5 a semicircular groove 6 of a radius of 1.5 mm in axial section and with a mean diameter of 42 mm, the external diameter of the dome being 45 mm.

At its upper end the dome 2 comprises an external enlargement portion 7 of an external diameter of 20 mm, for crimping thereto of a metal valve or dispensing pump cap.

EXAMPLE 2

The component (dome+skirt) 1 was used to produce a bag-type dispenser (see FIG. 2) using the process of the first production procedure. The lower end 9 of the skirt 4 was closed by welding in an arc configuration, the end 9 being folded over in a doubled semicircular form as indicated at 10 in the diagrammatic view in FIG. 4 and pinched over a height of 6 mm by welding. That arrangement gives a welded end 12 of the bag 13, of a curved configuration but of the same diameter as the skirt 4 and which does not involve any difficulty in introducing same into the casing 11. After welding, the weld 12 was cropped by about 2 mm, thus removing its excess length at its external unwelded end.

Figure 3:
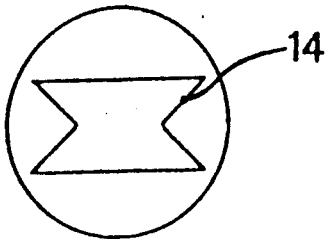
FIGS. 3 and 4 show views in section perpendicular to the axis of the contours of two end closures of the skirt.
Figure 4:
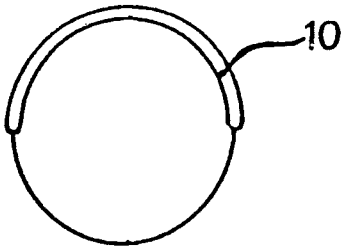

FIG. 3 shows in the same fashion as FIG. 4 another mode of folding the end of the skirt, referred to as a "bellows" configuration as indicated at 14, which provides the same advantage that the end of the bag is not enlarged, the end then being closed by glueing or by welding, the latter being a more delicate operation than in the case of welding in an arc configuration.

The casing 11 of the dispenser 8 is of aluminum, with the thickness of the cylindrical body being 0.35 mm, with an opening or throat 15 of an internal diameter of 36.5 mm, above which is disposed an edge 16 which is rolled over about 150°, with an external radius of 1.3 mm. The operation of fixing the dome 2 to the rolled edge 16, after closure of the bag 13 and the introduction thereof into the casing 11, was effected by surface oxidation of the circular groove 6 in the dome 2 (corona treatment) and glueing using cyanoacrylic glue of the groove 6 which is fitted over the rolled edge 16, with the assembly being held together for a little more than 1 minute while the glue dries.

Other known methods for surface treatment of the groove of plastics material may be employed, for example a treatment using a flame or with a shaping electrode (corona effect).

The metal fixing cap 17 of a dispensing means 18, which in this case is capped by a diffuser pushbutton 19, is crimped with a sealing member beneath the enlargement portion 7 on the upper end of the dome 2. When the dispensing means 18 is a valve for discharge of the product in question, the annular gap 20 between the casing 11 and the bag 13 is filled with a gas under pressure and the sealed plug 21 is then put back into position. When the means 18 is a pump without intake of air, there is no need for propellent gas and it is sufficient for the exterior of the bag 13 to be communicated with atmospheric pressure, which simplifies the packaging operation. In the present case, the plug 21 is eliminated and the bottom 22 of the casing which is provided with some orifice for the flow of air therethrough now only plays the part of providing protection for the bag, without being necessary for performing the dispensing operation.

EXAMPLE 3

The operation of fixing the dome 2 of the prefabricated component (dome+skirt) 1 to the casing is typically effected by the packaging manufacturer. Various methods can be used in mass production situations. The methods which involve metal casings, typically of aluminium or of tin plate of from 0.2 mm to 0.6 mm in thickness, the dispensers being pressurized or unpressurized, as has already been indicated above, are referred to hereinafter in relation to FIGS. 5 to 7.

Figure 2:
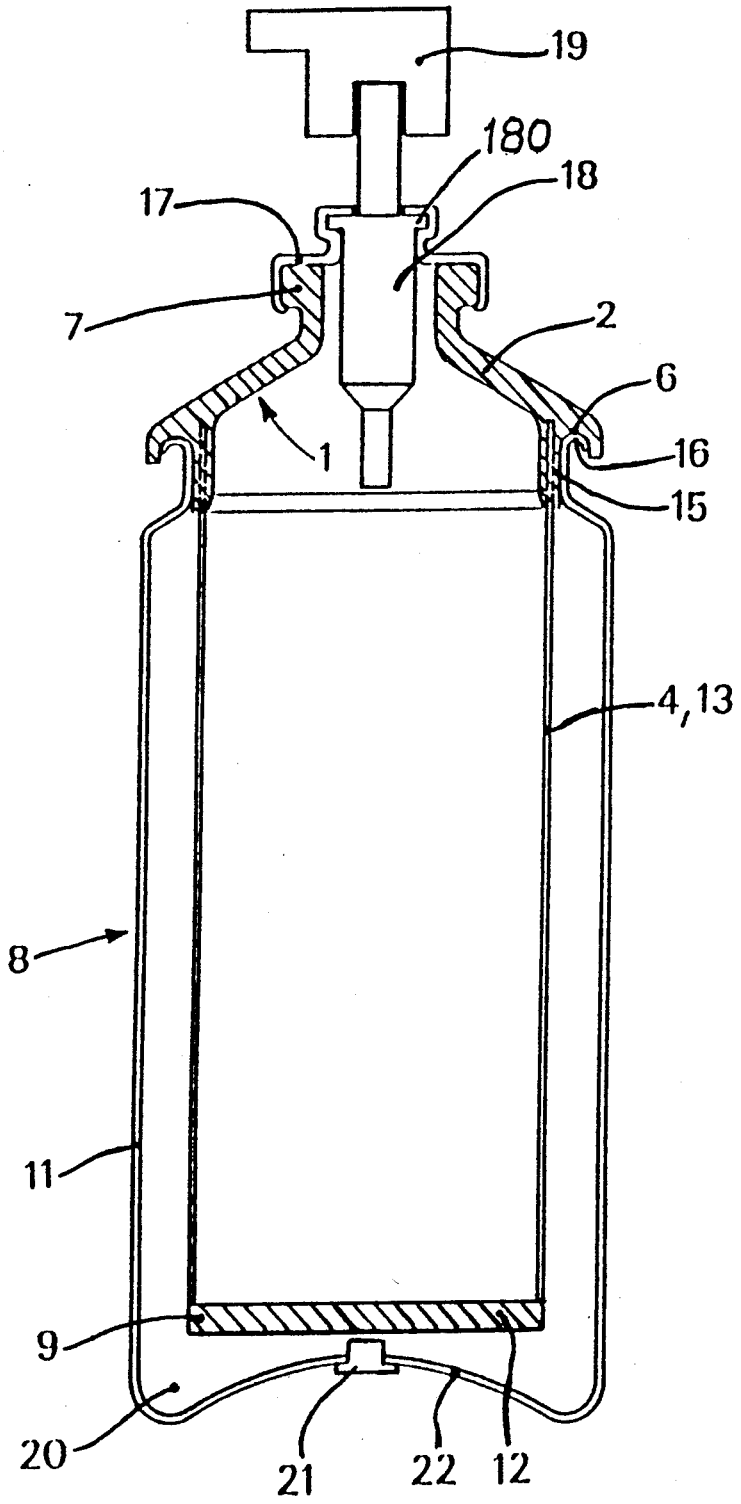
FIG. 2 is also a view in axial section of a dispenser produced from the FIG. 1 component (dome+skirt)
Figure 5:
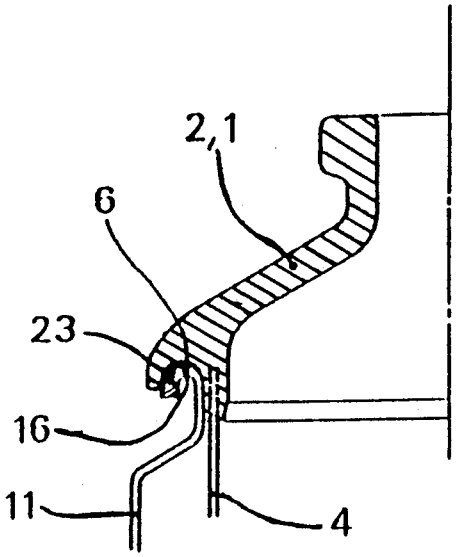
FIGS. 5 to 7 are views in axial section of halves of different methods of sealingly connecting the dome and the upper end of a metal casing.

FIG. 5 shows the fixing of a dome 2 provided with a skirt 4 of the same geometry as in the first two examples onto a casing 11 which is identical to the casing in FIG. 2 by means of an annular connecting member 23 compatible both with the plastics material of the dome 2—in this case HD-PE—and the metal of the casing 11—in this case aluminium. The moulded component 23 which is 0.2 mm in thickness is of a complex material containing the same polyolefin as that of the dome 2, that is to say PE, and EAA; its external edge is clipped over the end of the rolled edge 16 and, after the component 1 has been set in position, with the dome 2 being applied to the connecting member 23 by way of its circular groove 6, the welding operation is carried out using one of the following methods: high frequency induction, rotation or ultrasonic, while modifying the form of the dome for the ultrasonic transducer to bear thereagainst.

Figure 6:
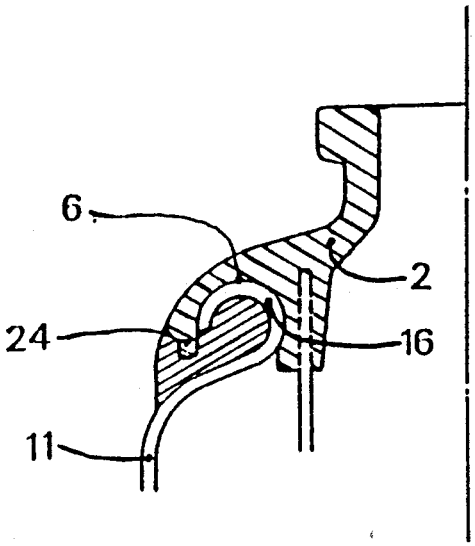

It will be seen from FIG. 6 that the dome 2 which is set in position by way of its circular groove 6 over the rolled edge 16 of the casing 11 has an end portion of the circular groove 6, which projects by about 1 mm beyond the end of the rolled edge 16, without obstructing the interior of the rolled edge 16. By annular injection of plastics material of the same nature as that of the dome, in this case PE, the internal cavity of the rolled edge 16 is at least partially filled by partially melting the external lip 24 of the dome which borders the end portion of the circular groove 6, the lip 24 being 1 mm in thickness at that location. That produces a sealed welded connection of high quality. Generally speaking the end portion 24 of the dome 2 which is thus secured in position by the moulding operation must be disposed in the vicinity of the end of the rolled edge, that is to say less than 0.5 mm in front of that end or a little further, leaving at least 1 mm clearance towards the interior of the rolled edge 16.

Figure 7:
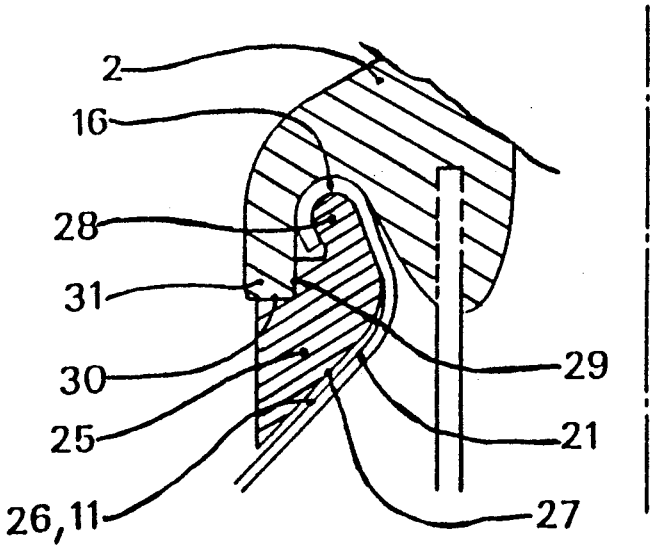

The fixing method used in FIG. 7 uses an annular shaped component 25 of plastics material of the same nature as that of the dome 2, the top of which is not shown, the component 25 being set in position on the necked end 26 of the casing before the operation of rolling its end edge. The component 25 which in this case is of PE like the dome 2 comprises a base 27 which bears against the shoulder 26 of the casing 11, an upper portion 28 which will be crimped as represented by the rolling of the upper end edge of the casing and one or more surfaces, in this case the two surfaces 29 and 30, which come into contact with the external skirt 31 of the dome 2. The operations of setting in position the component 25, the rolled edge 16 and the dome 2 having been carried out, the sealing fixing operation is effected by rotational welding of the annular surfaces 29 and 30 to the annular portion 31 of the dome 2. The fixing may also be effected by HF induction or ultrasonic welding.

EXAMPLE 4

Figure 8:
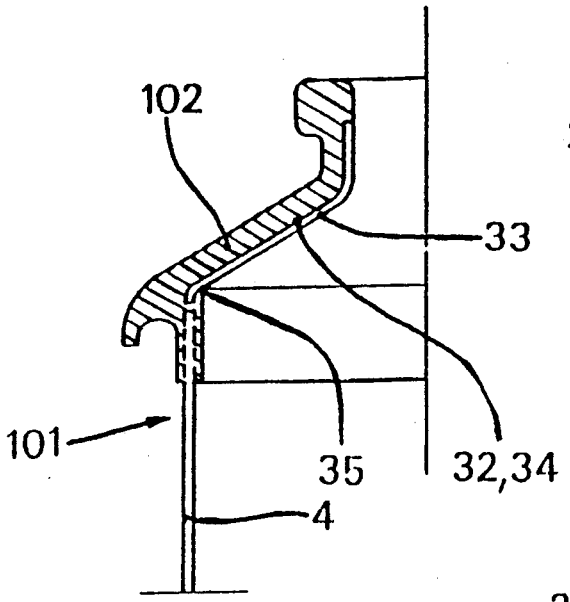
FIG. 8 is a view in axial section of half of a component (dome+skirt) in which the dome is provided on its reverse face with an insert forming a barrier for scents.

The external geometry of the preassembled component 101 (see FIG. 8) is the same as that of the component 1 but the reverse surface 32 of its dome 102 was provided with an annular barrier-effect disc or ring member 33 in the operation of moulding the dome 102 onto the skirt 4. The ring member 33 is welded to the dome 102 by way of a large face 34 thereof and is retained at its base by a small annular bead 35 of plastics material. It generally has surface layers of polyolefin which is compatible with the polyolefin of the dome and an intermediate layer of Al or barrier plastics material. In this case the ring member 33 is made from the metalloplastic complex of a thickness of 0.28 mm which was used in the first example.

EXAMPLE 5

Figure 9:
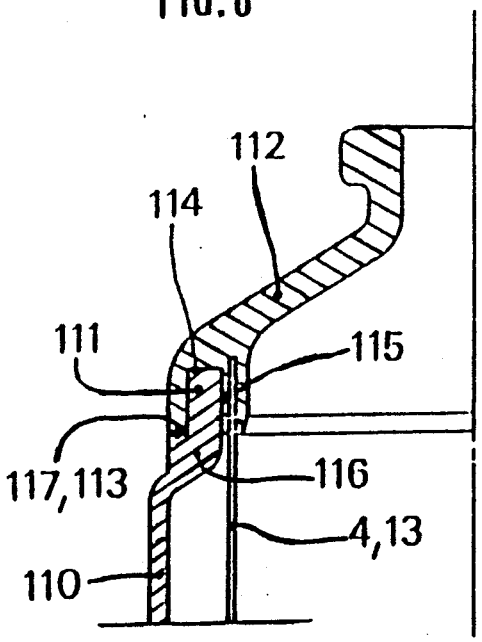
FIG. 9 is a view in axial section of half of the assembly of a component (dome+skirt) and the top end of a casing of plastics material.

The casing 110 in FIG. 9 is of plastics material, in this case HD-PE, of a thickness of 0.6 mm in its cylindrical portion. At its upper end 116 the moulded casing has a tubular portion 111 of rectangular axial section, which is fitted with a clamping action between the internal tubular portion 115 and an annular groove 114 in the dome 112, the tubular portion 111 being applied by way of its horizontal end against the bottom of the groove 114. Fixing is preferably effected by rotational welding but it can also be produced by glueing. The annular horizontal surface 113 and the end of the external lip 117 of the dome 102 may also be involved in that fixing.

EXAMPLE 6

Figure 10:
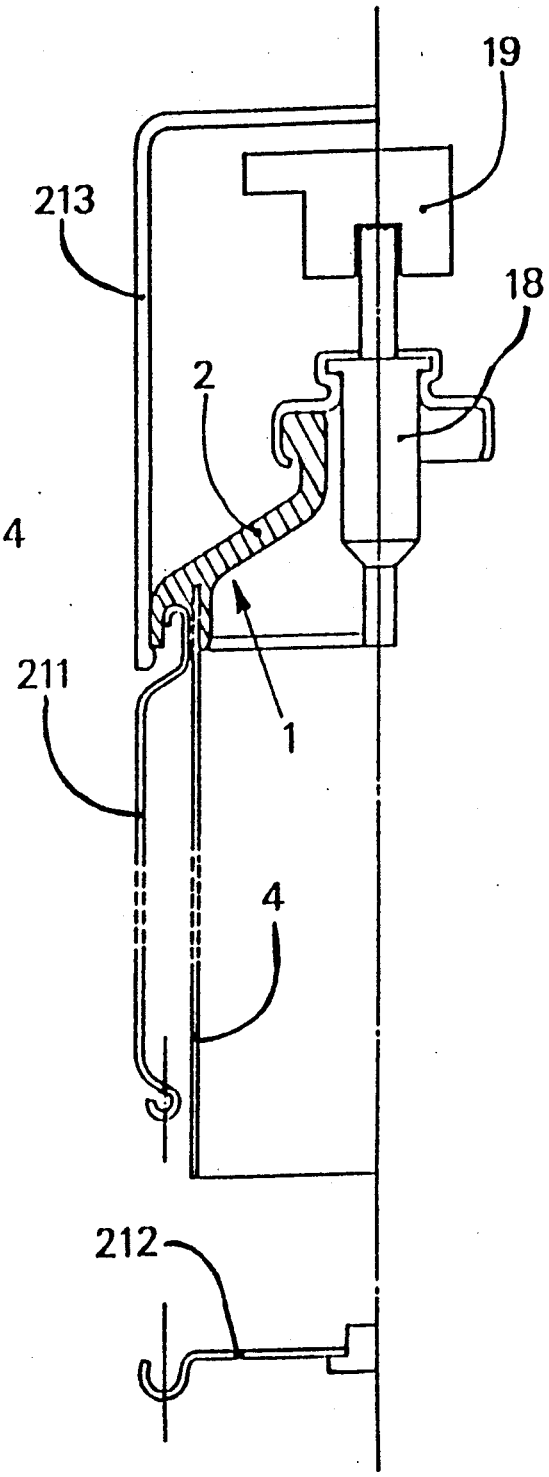
FIG. 10 is a view in axial section of part of a dispenser with a metal casing, the bottom of which is to be crimped, corresponding to the third production procedure described above.

FIG. 10 illustrates the process of the third production procedure. The preassembled component 1 is the same as in the first two examples and fixing of the component 1 to the upper end of the casing 211 with a separate bottom 212, the casing being of tin plate with an external diameter of 47 mm and being 0.3 mm in thickness, is effected in the same way as in the second example, although the skirt 4 is not closed. A cap member 213 is provided to protect the dispensing means 18 and 19 and the filling operation is effected in the inverted position by way of the open end of the skirt 4 which projects from the body of the casing 211. The end of the skirt 4 is then closed, typically by means of one of the methods already described in the second example, the closed end is cropped and it is put back into the body 211 and then the bottom 212 is crimped into position. The dispenser is then pressurized if necessary as already described above.

EXAMPLE 7

Figure 11:
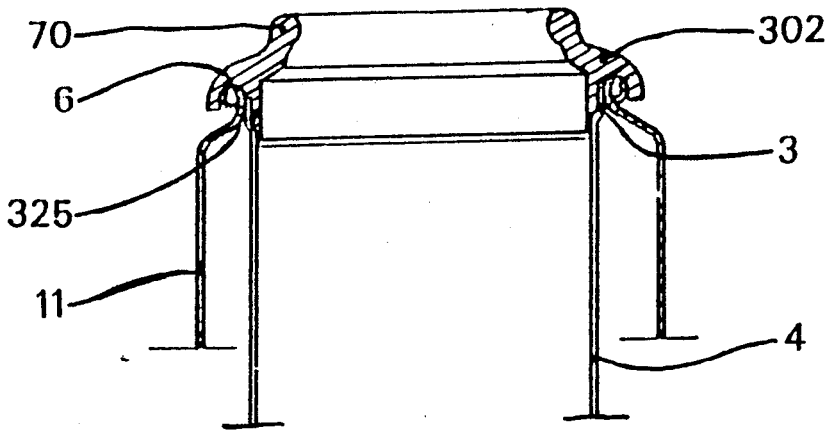
FIG. 11 is a view in axial section of an assembly of a component (dome+skirt) and the top end of a metal casing, the skirt and the dome being assembled by moulding.

FIG. 11 shows a dome 302 of HD-PE which is moulded onto the upper end portion 3 of a metalloplastic skirt 4 identical to the skirt 4 in example 1. In the present case the internal tubular portion 325 of the dome 302 is moulded onto the interior of the end 3 of the skirt 4, the tubular portion 325 being reinforced by a thickening of its upper part which constitutes a part of the periphery of its annular semicircular groove 6 for fixing onto the casing 11.

The flared arrangement of the end 3 around the tubular portion 325 results from the direction of injection of the HD-PE, the injection operation causing the end 3 to bear against the annular moulding tool.

The operation of fixing the dome 302 to the rolled edge of the casing 11 is effected by glueing using the cyanoacrylate glue in the same manner as in example 2. The upper enlarged part 70 of the dome 302 permits fixing of the dispensing means by expanding or flanging over same.

EXAMPLE 8

Figure 12:
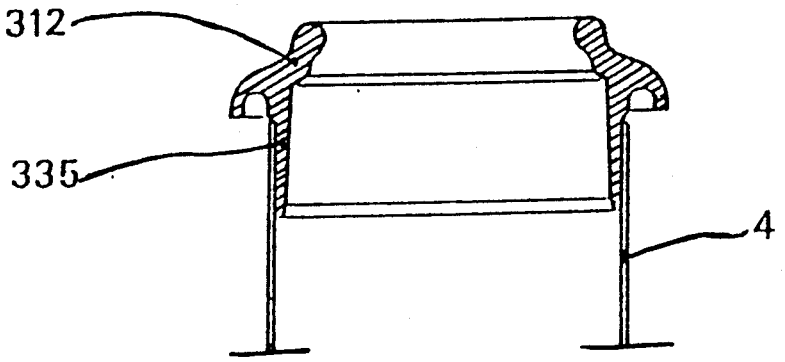
FIG. 12 is a view in axial section of a component (dome+skirt) which is assembled by glueing.

FIG. 12 shows a dome 312 of polyamide PA 12, the internal tubular portion 335 of which, being 34.3 mm in external diameter, is glued over a height of 12 mm to the interior of a metalloplastic skirt 4 identical to the preceding skirts. That arrangement was the subject of an array of glueing tests concerning domes of different materials:

PA 12 (=Rilsan ®)
PA 6 (=Nylon ®)
HD-PE
Linear PE the domes being glued to the rolled edges at the upper ends of aluminium casings, with families of glues:

a silicone glue "Rhodorseal 5552" (®)
three cyanoacrylate glues:
No 406 Loctite (®)
No 202 Cyanolit (®)
No 208 Cyanolit (®)

The observations made can be summarized as follows: the surfaces of plastics material must preferably be prepared by surface oxidation such as flame treatment or corona effect treatment and aluminium surfaces must preferably be lacquered beforehand, as those glues do not give satisfactory adhesion to bare aluminium. The silicone glue requires pressing times of 1 to 2 minutes and drying times under ambient conditions or more than 24 hours. The three cyanoacrylate glues give similar results: the pressing times can be limited to 5 to 10 seconds and the components can be handled after 30 seconds to 1 minute at ambient temperature. The cyanoacrylate glues are therefore preferable for industrial uses.

Figure 13:
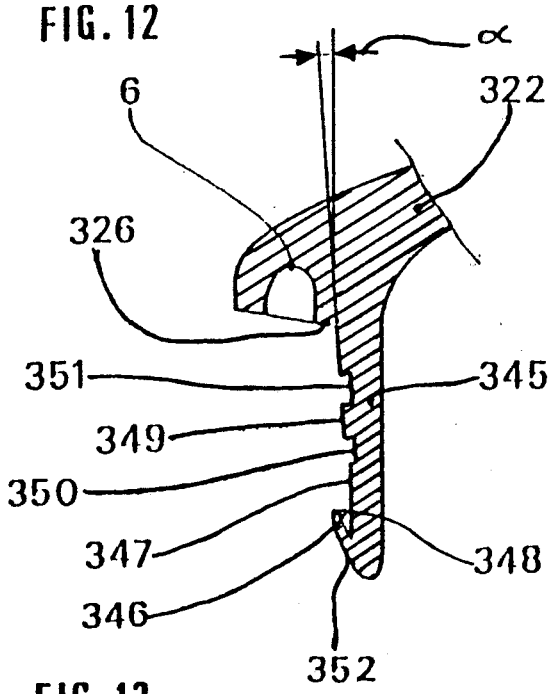
FIG. 13 is a view in axial section of half of the internal tubular portion of a dome provided with means for distribution of the glue.

In the glueing tests it was observed that the operation of fitting the skirt 4 around the tubular portion 335 of the dome in a properly centered relationship was a delicate one and that sometimes there were deficiencies in respect of the glued connection, corresponding to the glue being excessively scraped off by the end of the skirt 4. Then, after a number of tests, a dome 332 of HD-PE, as shown in FIG. 13, was produced, in which the tubular portion 345, starting from the lower end thereof, comprises: a flexible lip 346 which with the external circular cylindrical surface 347 of the tubular portion 345 defines an annular reserve 348 of a height of 2.5 mm, and then, 5 mm above the lower end, an external frustoconical surface portion 349 with a half cone angle of between 1 and 2; the portion 349 comprising two recessed annular zones 350 and 351 of a depth of 0.06 to 0.08 mm, the zones of unitary heights of 2 mm being connected to each other and to the cylindrical portion 347 by a plurality of recessed bridging portions of a unitary width of 4 mm. The external frustoconical surface 349 is extended to the lower rim 326 of the dome 322 corresponding to the open end of the groove 6 for fixing onto the casing, the rim 326 serves as an abutment and controls the distance with which the skirt 4 is fitted onto the tubular portion around same, fixing it at a height of 14 mm. Taking account of the system for providing reserves of glue as indicated at 348, 350 and 351, the skirt 4 is a slightly clamping fit around the tubular portion 345 and, for an internal skirt diameter of 34.45 mm with a progressive-entry end part 352 on the tubular portion, we have: a diameter for the external cylindrical surface 347 of 34.1 mm, a flexible lip 346 of a thickness of 0.15 to 0.2 mm at its root and an external frustoconical surface 349 which terminates with a diameter of 34.5 mm. Tests with cyanoacrylate glue deposited in advance in the annular reserve 348 gave reproducible results and, according to the tests in respect of detachment of the skirt 4, a reliable sealing effect is obtained at the location of each of the recessed zones 350 and 351.

EXAMPLE 9

Figure 14:
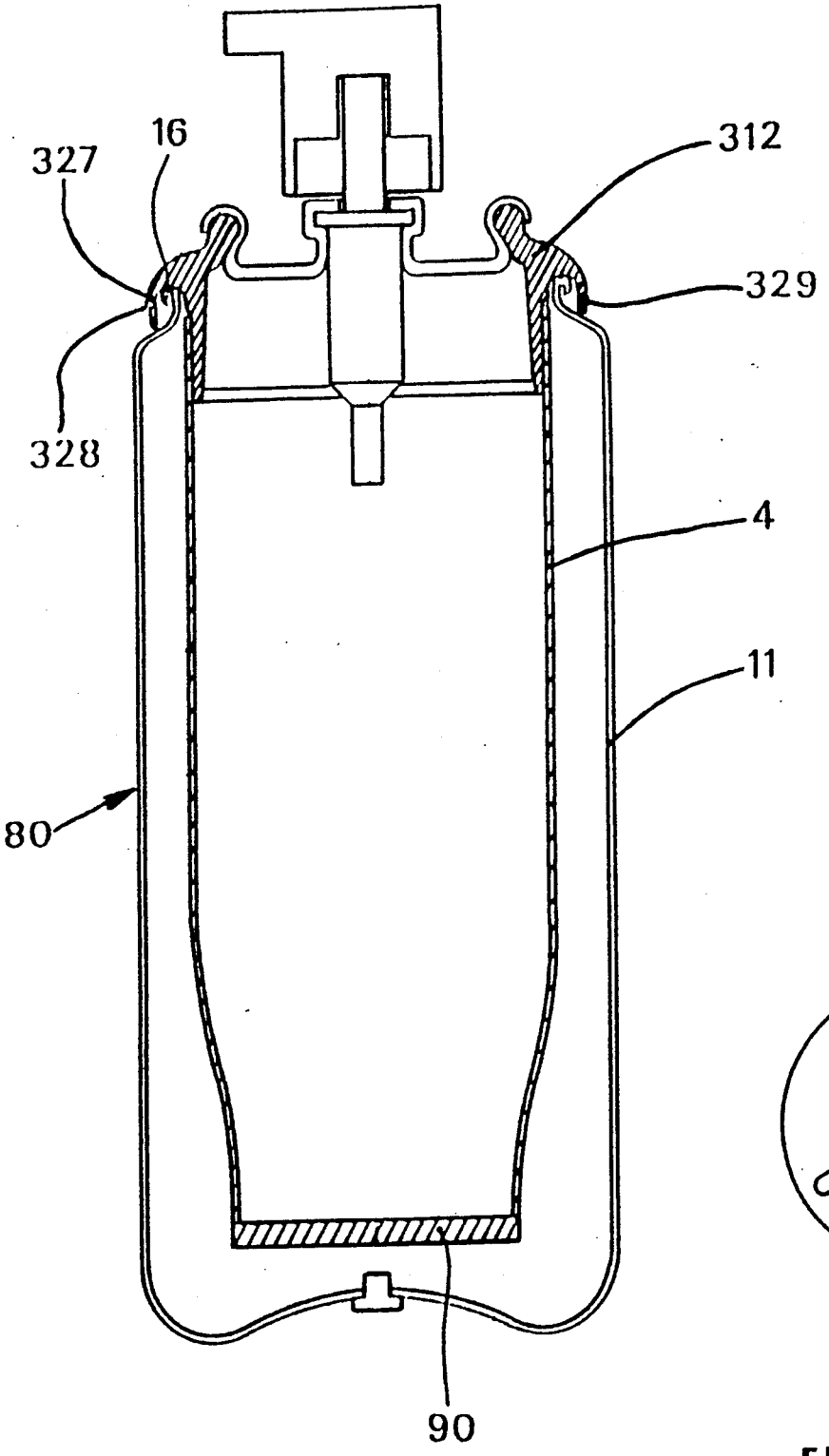
FIG. 14 is a view in axial section of a dispenser obtained from the component (dome+skirt) shown in FIG. 12.
Figure 15:
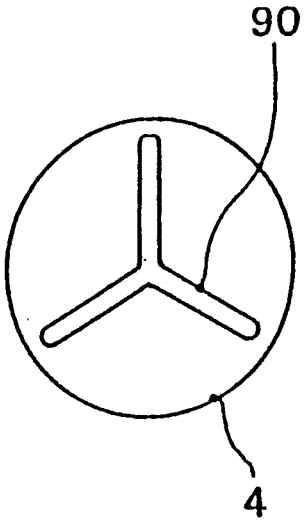
FIG. 15 is an end view of the contour of the weld in the form of a triangular star on the bag of the preceding dispenser.
Figure 16:
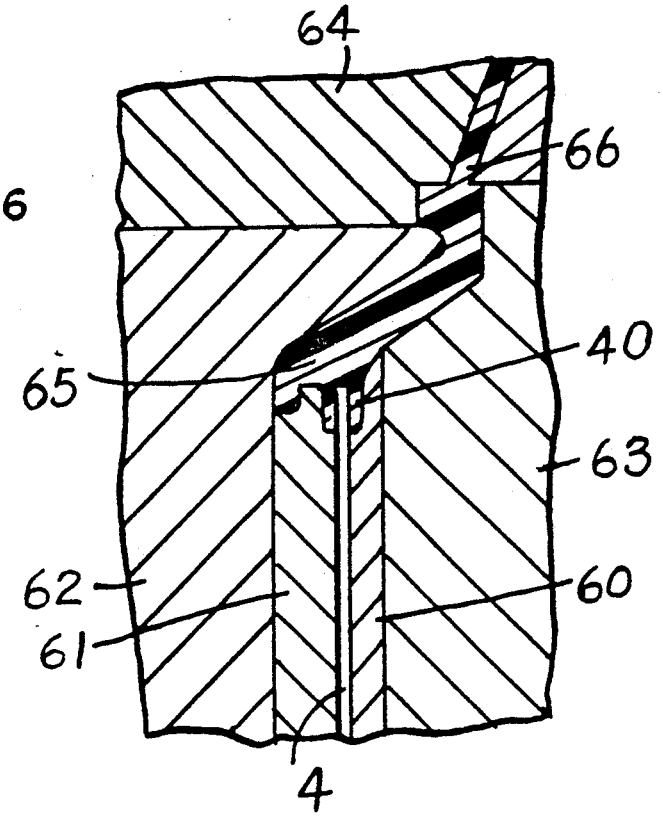
FIG. 16 is a view in axial section of half a moulding assembly of a component (dome+skirt)
Figure 17:
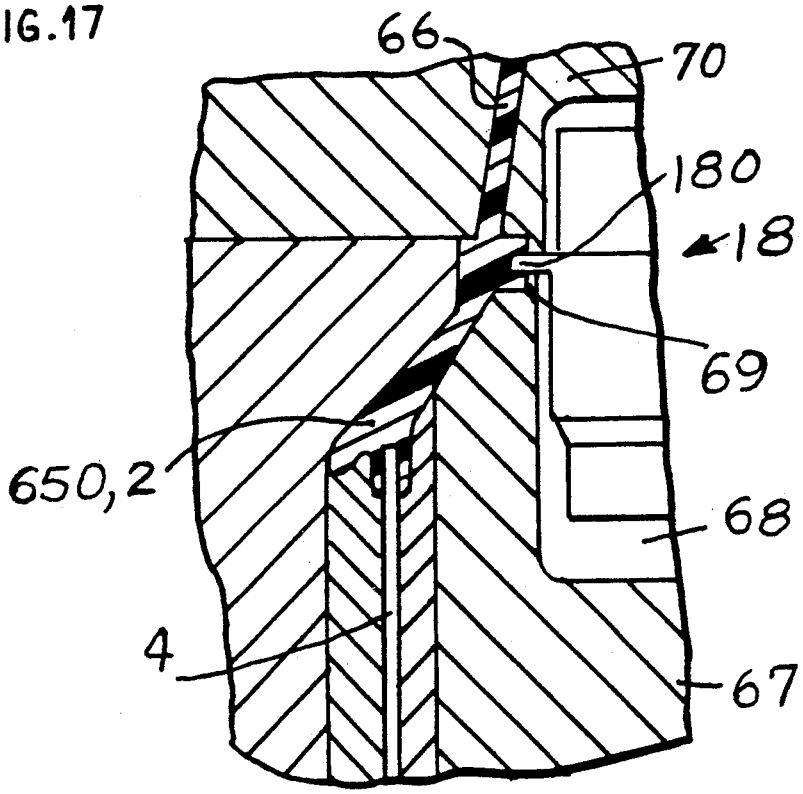
FIG. 17 is a view in axial section of half a moulding assembly of a component (dome+pump).

This example used a component (dome+skirt) 312 and 4 (see FIG. 14) which was preassembled by glueing (example 8 and FIG. 12) to produce a bag-type dispenser 80 using the process of the first production procedure. In comparison with example 2, there are the following additional differences:

the lower external rim 327 of the dome 312 which borders its annular groove 6 for fixing by glueing onto the rolled edge 16 of the casing 11 which is made of aluminium comprises a small overhanging edge 328 which permits a protective cap (not shown) to be fitted by clipping, and a small skirt or extension portion 329 which masks the fixing of the dome 312 onto the rolled edge 16;

as shown in FIG. 15, the lower end 90 of the skirt 4 was welded in a triangular configuration or more precisely in the form of a triangular star or with three substantially equal arms, prior to the skirt 4 being introduced into the casing 11. The welding operation was effected by means of 3 insulating grippers and an HF induction loop, being a method which produces sufficient flow of the PE to produce a sealing effect at the centre of the star. It is also possible to use ultrasonic welding. That arrangement in the form of three flexible folds which progressively return to the circular cylindrical shape of the top of the skirt 4 permits the bag produced to be introduced in a particularly convenient fashion into the casing of the dispenser. Four folds or more are also possible.

ADVANTAGES

Major advantages have already been referred to at the beginning of the description of the invention.

The tests performed made it possible to demonstrate another advantage which is particularly surprising and attractive from the economic point of view. The use of the dome of plastics material makes it possible to reduce the extent of shaping of the upper end of the casing when using a metal casing. It is then possible substantially to reduce the thickness of the cylindrical portion of the casing, the sole requirement in respect of resistance to internal pressure permitting lateral wall thicknesses which are smaller than with the same requirement in association with the requirement in respect of strength of the heavily shaped dome. That reduction in wall thickness is typically from 20 to 35% relative.

USES

The use of the production process of the invention and the corresponding bag-type dispensers extends to the dispensing of products in the form of aerosols, liquids and creams or gels, in the pharmaceutical, cosmetology, hygiene and foodstuff fields.

We claim:

1. A process for the production of a bag-type dispenser and the packaging therein of a product to be dispensed, comprising the steps of:

(a) providing a tubular casing, a tubular skirt portion, and a dispensing means;

(b) moulding a one-piece annular dome of plastics material comprising an annular upper portion to be directly fixed to said dispensing means, a lower tubular portion to be directly fixed to said tubular skirt portion, and outside said lower tubular portion an outer annular portion for directly and sealingly fixing said dome to an upper end of said tubular casing;

(c) directly and sealingly fixing an upper end of said tubular skirt portion forming a blank for a bag to said lower tubular portion of said dome over a height from 5 to 20 mm, obtaining a preassembled dome+skirt component, whereby the filling of said product can be done by way of an open lower end of said skirt before closing said end;

(d) directly and sealingly fixing said dispensing means to said annular upper portion of the dome of said preassembled component; and (e) directly and sealingly fixing said tubular casing to said outer annular portion.

2. A process according to claim 1, comprising fixing said upper end of said tubular skirt portion to said lower tubular portion of the dome over a height of 8 to 15 mm.

3. A process according to claim 1, wherein the step of fixing said upper end of said tubular skirt portion to said lower tubular portion of said dome comprises moulding, comprising the steps of:

(a) fitting said tubular skirt portion around a punch tool, the upper end of said skirt portion projecting beyond said punch tool by a selected length;

(b) assembling a tool internal to said punch tool and, around said skirt portion, assembling die tools and die bottom tools, all these tools defining with said projecting end of said skirt portion an annular space corresponding to the dome to be moulded;

(c) feeding plastics material into said annular space by means of at least two injection ducts; and obtaining said component by unmoulding.

4. A process according to claim 3, wherein said plastics material is a polyolefin and wherein said skirt portion is of a complex material comprising barrier layers and surface layers of a polyolefin which is compatible in moulding with said polyolefin of said dome.

5. A process according to claim 1, wherein the steps of fixing said upper end of said tubular skirt portion around said lower tubular portion of the dome comprises gluing, the surface of said lower tubular portion which is to be glued comprising at least one annular recessed zone of a depth of less than 0.15 mm, and oxidizing at least one of the surfaces of said two portions before gluing by the flame process or the corona effect process.

6. A process according to claim 5, wherein said surface of said lower tubular portion of the dome which is to be glued comprises at least two annular recessed zones which are connected together by recessed bridging portions, said zones each being of a height of between 0.5 and 2.5 mm and a depth of between 0.04 and 0.1 mm.

7. A process according to claim 5, wherein said annular recessed zone is preceded by an end portion of said lower tubular portion which bears an upwardly inclined flexible annular lip serving as a reserve for glue, the bottom of said reserve being connected to said annular recessed zone by recessed briding portions, the operation of fitting said skirt around said tubular portion then causing said flexible lip to be squeezed down and resulting in the glue being expelled towards said recessed annular zone by way of the recessed bridging portions.

8. A process according to claim 6, wherein said annular recessed zones are preceded by an end portion of said tubular portion which bears an upwardly inclined flexible annular lip serving as a reserve for glue, the bottom of said reserve being connected to the most closely adjacent recessed annular zone by recessed bridging portions, the operation of fitting said skirt around said tubular portion then causing said flexible lip to be squeezed down and resulting in the glue being expelled towards said recessed annular zones by way of the recessed bridging portions.

9. A process according to any one of claims 5 to 8, wherein the step of gluing comprises gluing with a cyanoacrylate glue, said annular dome being of a plastics material selected from the group consisting of polyamide, polycarbonate, and polyacetal, and the interior of said skirt portion being of polyethylene.

10. A process according to any one of claims 1 to 8, wherein said dispensing means comprise a valve, comprising the steps of:

(a) turning over the assembly of the preassembled component and the dispensing means and filling the skirt, which is closed by the dome and by said dispensing means, with a product to be dispensed by way of the lower end of said skirt which is upwardly disposed;

(b) closing the lower, upwardly disposed end of the filled skirt, said skirt becoming a filled bag;

(c) introducing the filled bag into said casing;

(d) performing said step of directly and sealingly fixing said tubular casing to said outer annular portion by sealingly fixing said casing having the filled bag therein to the outer annular portion of said dome; and (e) introducing a gas under pressure between said bag and said casing.

11. A process according to any one of claims 1 to 8, wherein said dispensing means comprise a pump with a zero intake of air, comprising the steps of:

(a) turning over the assembly of the preassembled component and dispensing means and filling the skirt which is closed by the dome and by said dispensing means, with a product to be dispensed by way of the lower end of said skirt which is upwardly disposed;

(b) closing the lower, upwardly disposed end of the skirt, said skirt becoming a filled bag;

(c) introducing the filled bag into said casing; and (d) performing said step of directly and sealingly fixing said tubular casing to said outer annular portion by sealingly fixing said casing having the filled bag therein to the outer annular portion of said dome.

12. A process according to claim 3, wherein the dispensing means comprise a pump with a zero intake of air, provided with an annular fixing rim at lest externally of plastics material, wherein said annular moulding space contains also the periphery of said annular rim of the pump, said pump being contained in and protected from the heating effect of the moulding operation by a lower tool with a central cavity which is surmounted by a rim supporting sealingly said annular rim of said pump and by another tool which caps the pump and bears sealingly against said annular rim, said moulding operation producing a dome of plastics material sealingly moulded both onto said skirt portion forming the blank for said bag and around said annular rim of said pump, comprising the steps of:

(a) turning over the assembly of the preassembled component and pump and filling the skirt which is closed by the dome and by said pump and its annular rim with a product to be dispensed, by way of the lower end of said skirt which is upwardly disposed;

(b) closing the lower, upwardly disposed end of the skirt which becomes a filled bag;

(c) introducing the filled bag into the casing; and (d) performing said step of directly and sealingly fixing said tubular casing to said outer annular portion by sealingly fixing said casing having the filled bag therein to the outer annular portion of said dome.

13. A process according to any one of claims 1 to 8 wherein said casing is metal and comprises a separate tubular body and a bottom, comprising the steps of:

(a) introducing the skirt of the dome assembled to the skirt and the dispensing means into the body of the casing;

(b) performing said step of directly and sealingly fixing said tubular casing to said outer annular portion by sealingly fixing said assembly by means of its dome portion to the upper end of said casing body; and then at packaging;

(c) turning over the resulting complex assembly and filling the skirt which is closed by the dome and the dispensing means with a product to be dispensed, by way of the lower end of the skirt which is upwardly disposed;

(d) closing the lower, upwardly disposed end of the skirt which becomes a filled bag; and (e) with the filled bag in the casing, crimping the metal bottom, which is pierced with a hole, over the open lower end of the tubular body.

14. A process according to claim 13, wherein said dispensing means comprise a valve, additionally comprising, after crimping, introducing a gas under pressure between said bag and said casing and closing said hole of said metal bottom.

15. A process according to claim 13, wherein said dispensing means comprise a pump with a zero intake of air, bearing an annular fixing rim at least externally of plastics material, comprising producing a dome of plastics material and moulding both onto the skirt forming the blank for the bag and around said fixing rim of the pump.

16. A process according to claim 10, wherein said casing is of plastics material, comprising sealingly fixing said casing by rotational welding.

17. A process according to claim 11, wherein said casing is of plastics material, comprising sealingly fixing said casing by rotational welding.

18. A process according to claim 1, wherein said casing is of metal and comprises a rolled edge at its upper end, said outer annular portion of said dome comprising a circular groove of plastics which fits onto said rolled edge, comprising sealingly fixing said circular groove to said rolled edge, and thereby fixing the casing to the dome.

19. A process according to claim 18, comprising surface treating said circular groove of plastics by oxidizing and then gluing onto said rolled edge.

20. A process according to claim 13, wherein said metal tubular body comprises a rolled edge at its upper end, said annular portion of said dome for fixing it onto the casing comprising a circular groove of plastics which fits onto said rolled edge, comprising surface treating said circular groove by oxidizing and then gluing onto said rolled edge.

21. A process according to claim 18, wherein said circular groove of said dome projects beyond the end of said rolled edge when fitting on it, without obstructing the internal cavity of said rolled edge, comprising sealingly fixing said dome and said rolled edge together by annularly injecting plastics material of the same nature as that of said dome into said cavity.

22. A process according to claim 18, wherein a connecting member which is compatible both with said metal of said rolled edge and with said plastics material of said dome is disposed between said rolled edge and said circular groove, comprising sealingly fixing said dome and said rolled edge together by high frequency induction welding, ultrasonic welding, or rotational welding.

23. A process according to claim 18, comprising disposing an annular member of plastics material of the same nature as that of said dome around the end portion of said casing and rolling the end portion thereof, said member comprising a base which bears against the shoulder of said casing and an upper portion which will be crimped by the rolled end portion of said casing, and one or more surfaces which come into contact with said dome when said dome is set in position on the casing; and further comprising rolling the end portion of said casing around an upper portion of said annular member, then setting said dome in position on said upper rolled end portion of said casing, and fixing together said dome and said upper portion of said annular member by rotational welding.

24. A process for the production of a bag-type dispenser and the packaging therein of a product to be dispensed, comprising the steps of:

(a) providing a tubular skirt portion and a dispensing means;

(b) moulding an annular dome of plastics material comprising an annular upper portion to be fixed to said dispensing means, a lower tubular portion comprising at least one annular recessed zone to be fixed to said tubular skirt portion, and outside said lower tubular portion an annular portion for sealingly fixing said dome to a tubular casing at one end of the casing;

(c) sealingly fixing an upper end of said tubular skirt portion forming a blank for a bag to said at least one annular recessed zone over a height from 5 to 20 mm, obtaining a preassembled dome+skirt component, whereby the filling of said product can be done by way of an open lower end of said skirt before closing said end; and (d) sealingly fixing said dispensing means to said annular upper portion of the dome of said preassembled component.

25. A process according to claim 24, wherein the depth of said at least one annular recessed zone is less than 15 mm.

26. a process according to claim 24 or 25, wherein the step of sealingly fixing the upper end of said skirt comprises oxidizing the upper end of said skirt or said at least one annular recessed zone by a flame process or corona effect process, and gluing the upper portion of the skirt within said at least one annular recessed zone.

* * * * *

UNITED STATES PATENT AND TRADEMARK OFFICE

CERTIFICATE OF CORRECTION

PATENT NO. : 5,031,384

DATED : July 16, 1991

INVENTOR(S) : Michel Rebeyrolle et al

It is certified that error appears in the above-identified patent and that said Letters Patent is hereby corrected as shown below:

COLUMN 16

Claim 25, line 3, change "15" to --0.15--.

Signed and Sealed this

Fifth Day of January, 1993

*Attest:*

DOUGLAS B. COMER

*Attesting Officer*

*Acting Commissioner of Patents and Trademarks*